United States Patent [19]

Kawai et al.

[11] 4,032,062

[45] June 28, 1977

[54] BOX AND METHOD OF MAKING THE SAME

[76] Inventors: Minoro Kawai; Kenji Muramatsu, both of Tokyo, Japan

[22] Filed: Feb. 9, 1976

[21] Appl. No.: 656,737

[52] U.S. Cl. ..... 229/20; 229/39 R; 229/44 CB

[51] Int. Cl.[2] ..... B65D 5/38; B65D 85/10

[58] Field of Search ..... 229/21, 22, 37 R, 38, 229/39 R, 44 CB

[56] References Cited

UNITED STATES PATENTS

| | | | |
|---|---|---|---|
| 715,789 | 12/1902 | Haas | 229/37 R |
| 797,175 | 8/1905 | Collenburg | 229/21 |
| 2,100,888 | 11/1937 | Vine | 229/22 X |
| 2,577,588 | 12/1951 | Paige | 229/39 R |
| 2,625,315 | 1/1953 | Fehrenkamp | 229/39 R X |
| 2,686,002 | 8/1954 | Inman | 229/39 R |
| 2,950,060 | 8/1960 | Von Rudeen | 229/44 CB |
| 3,067,925 | 12/1962 | Gillam | 220/44 CB |
| 3,231,170 | 1/1966 | Robinson | 229/44 CB X |
| 3,311,283 | 3/1967 | Shimada et al. | 229/44 CB X |
| 3,933,299 | 1/1976 | Shimada et al. | 229/44 CB |

FOREIGN PATENTS OR APPLICATIONS

| | | | |
|---|---|---|---|
| 3,974,956 | 8/1976 | United Kingdom | 229/44 CB |
| 3,977,520 | 8/1976 | United Kingdom | 229/44 CB |
| 3,973,724 | 8/1976 | United Kingdom | 229/43 |
| 386,577 | 1/1933 | United Kingdom | 229/44 CB |

*Primary Examiner*—Davis T. Moorhead
*Attorney, Agent, or Firm*—Richard J. Holton

[57] ABSTRACT

This invention relates to a box, particularly suited for the packing of a quadrangular object and a method of manufacturing the same. The box of this invention is made of elements including a sheet of paperboard in such way that the cover can be freely opened and closed.

1 Claim, 9 Drawing Figures

BOX AND METHOD OF MAKING THE SAME

BACKGROUND

It has been hitherto known to manufacture a package box from a sheet of base board, such as cardboard, paperboard or the like. It has also been known to prepare such a box having a double-walled construction, by stamping out, e.g. by die-cutting, a blank adapted to be folded into a pair of similar reactangular polygonal tubular members nested one within the other. In an embodiment of the latter form of box, it has been known to provide areas of said blank adapted to form connecting members between the portions of the blank forming the inside wall portions of the double-walled package with the respectively corresponding portions of the blank forming the outside wall portions, so that as the inside portion was inserted telescopically into the outside portion of the package, the connecting members were adapted to fold inwardly, cooperating to define an end closure for one end of the polygonal, tubular, double-walled package. This arrangement, however, required some compensation to be provided for the difference in cross-sectonal dimensions of the inner and the outer portions of the double-walled tube, resulting from the thickness of the wall material. This compensation was typically provided by making wide scores or fold-marks at the dihedral angles between adjacent sides of the inner tubular member, in such a manner, that the walls of the inside tubular member could be warped or deformed to provide the necessary compensation. However, this method is defective in that it tends to form unwanted creases or bulges owing to the warping and thereby to spoil the beauty of the package.

The present invention has eliminated these defects, and in addition provides a unique manner of opening and closing the cover (i.e. the end closure referred to above).

DETAILED DESCRIPTION OF INVENTION

Figure 2:
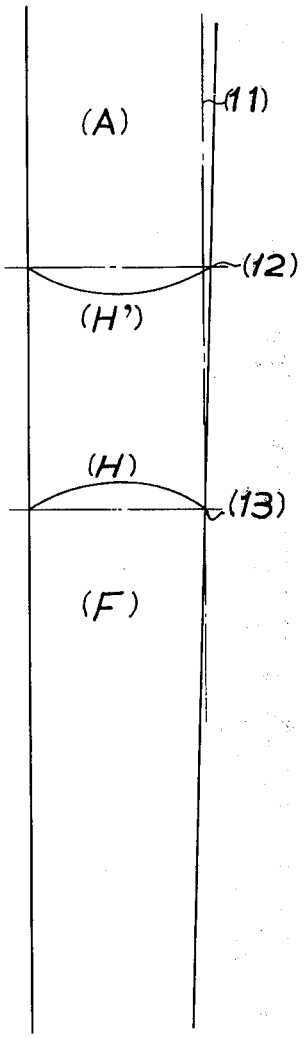
FIG. 2 is a detail showing the rectification of certain radial cut and score lines so as to define faces bounded by parallel lines.
Figure 1:
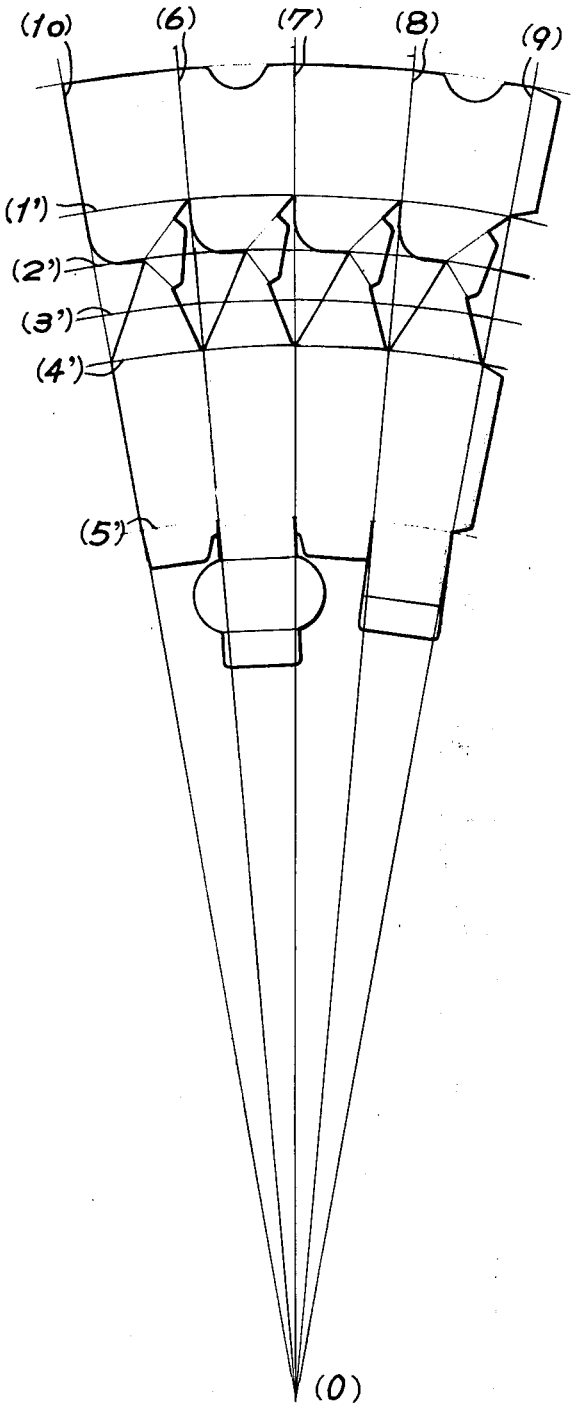
FIG. 1 is a plan view of a partially-formed blank for the box according to this invention, showing various construction lines and arcs used for determining the position of appropriate cuts and scores.

The present invention relates to a box particularly adapted for packing a rectangular object, which is so made of a sheet of base board (i.e., paperboard or the like) that the cover can be freely opened and closed, and also relates to the method of manufacturing thereof. The term "base board", as used herein, is intended to denote a material such as paperboard, cardboard, corrugated fiber board or synthetic resin sheet.

The manufacturing method comprises the steps of (a) marking a piece of paperboard or the like so as to divide it into a series of at least three panels in side-by-side relation, and two gluing flaps (G) and (G′), each connected to one of said panels along an outside edge of said panel and (*b*) marking said panels so as to subdivide each of them into an outer face (A), an outer cover portion (B), an inner cover portion (C), a connecting piece (D), an inner face (E) and a bottom portion (F) or (F′). The characterization of (E) as an "inner face" is not intended to imply that it faces inwardly of the box, but rather that it is an (outwardly facing) surface of the inner tubular member.

The marking method for dividing the piece of paperboard or the like into panels and sub-dividing the panels into various areas as described comprises that tentative lines (1′), (2′), (3′), (4′), and (5′) are drawn as arcs of concentric circles, having their centre at a point (0) outside the base board. Then equally-spaced radii (6), (7), (8), (9), and (10) of the same concentric circles are constructed, such that the number of such radii is one more that the number of dihedral angles between adjacent faces desired in the finished package (which number of dihedral angles of course is equal to the number of such faces, and may be 3, 4, 5, 6, etc., as desired. In the embodiment shown in the drawings, the number of such angles, and the number of faces, is four). The angular spacing between radii (6), (7), (8), (9) and (10) is so selected that the chord (H) of the arc of tentative line (4′) intercepted between two adjacent radii is equal to the desired width (13) of an inside face (E), and the chord (H) of the arc of tentative line (1′) intercepted between the same two radii is equal to the desired width (12) of an outside face (A), which, in turn, should be so selected that (H′) exceeds (H) (or (12) exceeds (13) ), by an amount substantially equal to the thickness of two plies of the base board from which the package is made (i.e., one ply thickness at each side).

Next, the intersections of radii (6), (7), (8), (9) and (10) with tentative lines (arcs) (1′), (2′), (3′), (4′), and (5′) are connected by straight lines (i.e., by chords of the respective arcs) to form straight line segments (1), (2), (3), (4) and (5), so that the resulting quadrilateral face areas are bounded by straight lines, except for the distal edge portion of the blank defining outside faces (A), which retain a slight curvature. This is ordinarily not objectionable, as this is an edge, rather than a fold score, and is almost straight in any event. If desired, the faces (A) can be made completely rectilinear by trimming this slightly-curved edge into a series of straight-line segments connecting its intersections with the radii (6), (7), (8), (9) and (10).

Figure 5:
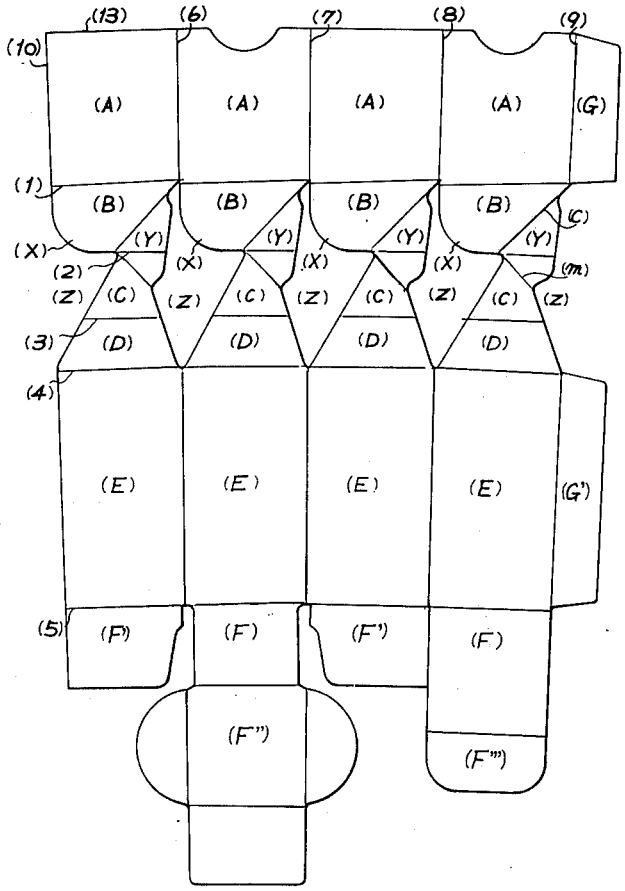
FIG. 5 is a plan view of a cut and scored blank for a box according to the invention, similar to FIG. 1, but showing the cut and score lines rectified to define faces bounded by substantially straight parallel lines.

Notches are provided along the lengths of the radii as best shown in FIG. 5, to define apertures (Z), to make the box slide freely. As will be seen on inspection of FIG. 5, the cuts defining apertures (Z) are so shaped as to leave protruding lobes (X) on one side of each outer cover portion (B) and tuck pieces (Y) on the portion of the blank connecting each outer cover portion (B) with its respective inner cover portion (C). Tuck pieces (Y) are provided with additional scores (c) and (m) for a purpose more fully explained below, to reinforce the cover and facilitate opening and closing thereof.

Finally the base board blank additionally comprises supporting pieces (F'), disposed alternately with bottom boards (F), one of the latter having thereon a false bottom piece (F'') and the other having thereon a closing flap (F''') (see FIG. 5).

Figure 3:
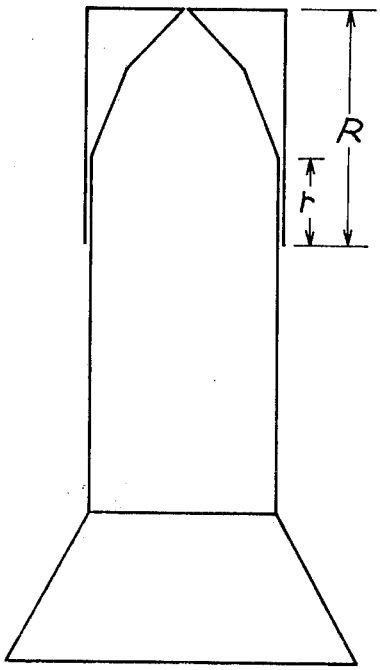
FIG. 3 is a sectional elevation of a box according to the invention, with the top in closed position.
Figure 4:
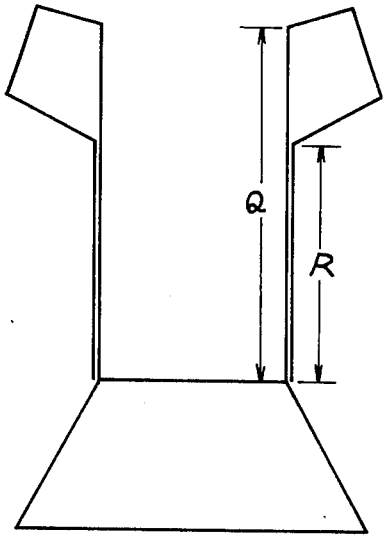
FIG. 4 is a sectional elevation similar to FIG. 3, showing the top in open position for comparison of the relative heights of the inner and outer sidewalls.

As shown in FIGS. 3 and 4, the height R of the outer face (A) is required to be able to overlap the inner face (E) by a length r, when the box is closed. The length R is also required to be shorter than the length Q of the panel portion bearing inner face (E) (see FIGS. 3 and 4).

FOLDING THE PREPARED BASE BOARD

Next, we shall explain the method of folding the prepared base board. First, the outer face (A) is placed over the inner face (E) by folding along the score (2). Then scores (1), (3) and (4) are flexed so as to bend freely inward and outward.

The bottom portions (F) and (F') are then bent upwardly toward inner faces (E) along score (5), and the inner faces (E) are bent into a rectangular tube by folding along scores (6), (7), (8), and (9), and secured by gluing flap (G') to the inner surface of the portion of the blank bearing inner face (E) defined in part by border radius (10). In similar fashiong, faces (A) are bent into a rectangular tube surrounding the first-mentioned tube in telescopically-nested fashion, and secured by flap (G).

Figure 8:
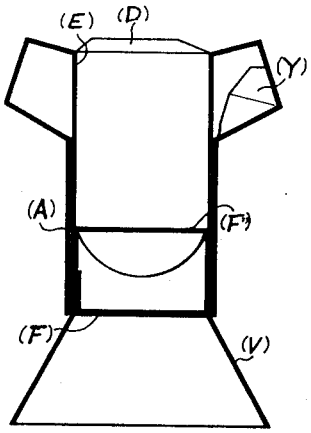
FIG. 8 is a section elevation along line 8—8 of FIG. 7, showing certain internal details including the construction of the false bottom.

Finally, the false bottom piece (F'') of the bottom board is bent to form the false bottom, as best seen in FIG. 8. Then the closing pieces (F') are bent inwardly to close the bottom and the closing flap (F''') is inserted to finish the container for the packaging of an elongated quadrangular object.

Figure 6:
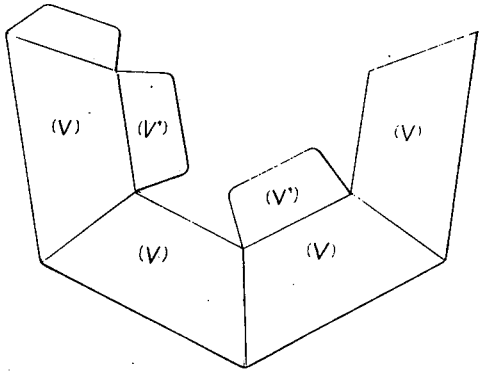
FIG. 6 is a plan view of a blank adapted to be folded and glued to the base of the box to form a pyramidal pedestal therefor.

A pedestal in the form of a truncated pyramid with trapezoidal faces (V) may be formed from a blank as illustrated in FIG. 6 by folding the blank along the score lines between adjacent trapezoidal faces (V) and securing them by means of a gluing flap similar to flaps (G) and (G') of FIG. 5. The inserting pieces (V') are inserted into or glued onto the bottom of the package container, whereby the container can be finished beautifully.

Figure 7:
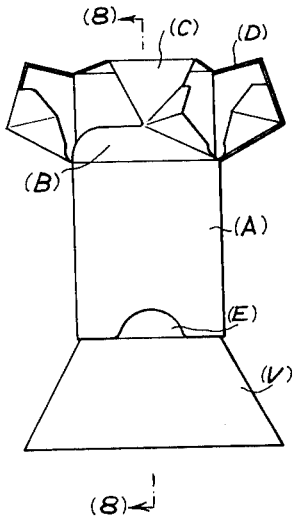
FIG. 7 is a front elevation similar to FIG. 4, showing the box with the top in open position, with some parts broken away to illustrate internal details.
Figure 9:
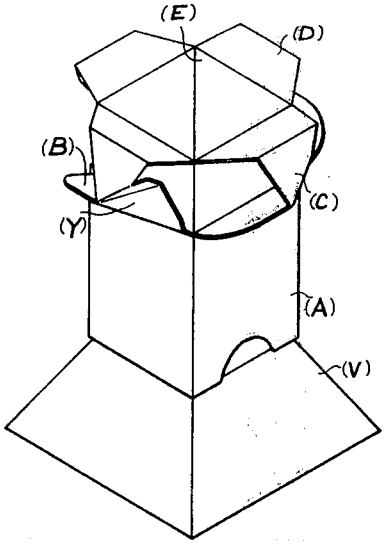
FIG. 9 is a perspective view of the box as shown in FIG. 7.

Now we shall refer to the manner of use of the container according to the present invention. First, if the outer section defined by outer faces (A) is lowered relative to the inner section defined by inner faces (E), this motion has the result that the outer cover boards portions (B), the inner cover portions (C) and the connecting pieces (D) are pulled so as to open the cover part. When the outside section defined by outer faces (A) is lowered further, the cover parts are spread outwardly until connecting pieces (D) flex outwardly along score line (4), as shown in FIGS. 7–9, to provide a complete opening.

By the contrary operation, namely if the outer faces (A) are pulled upwardly with respect to inner faces (E), the cover parts may be restored to their original position.

While the present invention has been described and illustrated with particular reference to a four-sided container particularly adapted for packaging an object having a quadrangular cross-section, it will be obvious to those skilled in the art that fewer or more sides may be provided to form other polygonal containers adapted for packaging objects having cross-sections which are, for example, trigonal, pentagonal or hexagonal, etc.

As explained above, a container can be easily made from a single sheet of paperboard or the like according to the present invention. The paperboard or the like may be formed into a blank for such container by a single pressing.

Moreover, the subsequent assembly of the package may be performed mechanically and automatically, so that it becomes labor-saving and economical.

Furthermore, the cover part may be opened and closed with one touch by sliding the outside portion, so that the article contained may be easily put in and taken out. The manner of opening and closing the cover part is novel, unique and excellent in function as well as aesthetic effect.

What is claimed is:

1. A polygonal box formed from a sheet of paperboard or the like, comprising a plurality of panels corresponding in number to the number of sides of said box, each of said panels comprising in combination an outer face, an outer cover portion, an inner cover portion, , a connecting piece, , an inner face and a bottom portion, said portions being connected together in the order named, said outer cover portion being provided on a first side with a protruding lobe adapted to cooperate in overlapping relation with similar lobes on other outer cover portions, to form a closure for the top of said box, and on a second side opposite said first side with a tuck piece connecting said outer cover portion with said inner cover portion, said inner cover portion and said connecting piece being shaped to define a notched aperture effective to provide clearance between the edges of said tuck piece on the one hand and the flat surfaces of said inner cover portion and connecting piece on the other hand, during the operations of opening and closing said package.

2. A polygonal box according to claim 1, comprising four of said sections adapted to be folded to define a pair of telescopically-nested, four-sided box portions, wherein said lobes cooperate to form an overlapping closure for the top of said box.

3. A blank adapted to be folded into a polygonal box comprising telescopically nested, relatively slidable inner and outer members, said blank comprising in combination at least three sections, each of said sections comprising a generally quadrilateral outer face defined by a top edge, a bottom edge, and two side edges, a generally quadrilateral inner face defined by a top edge, a bottom edge and two side edges, and a cover-forming and connecting intermediate area connected along a first score to said top edge of said outer face and along a second score to said top edge of said inner face, said cover-forming and connecting intermediate area comprising;

1. A portion in the nature of an outer cover portion, said outer cover portion being provided at one side thereof with a transversely-projecting lobe adapted to cooperate with similar lobes on other sections to form a cover by piling said lobes in overlapping relationship so as to close the open end of a polygonal tube made by edgewise juxtaposition of successive outer faces, 2. A portion in the nature of an inner cover portion adapted to underlie said outer cover portion substantially coextensively therewith, excluding said lobe,
3. A tuck piece connecting said outer cover portion and inner cover portion, and adapted to be reflexively folded and tucked between said outer cover portion and said inner cover portion, and
4. a connecting piece connecting said inner cover portion with said inner face, the length of said top and bottom edges of said outer face exceeding the length of said top and bottom edges of said inner face by an amount substantially twice the thickness of the material of said blank.

4. A blank according to claim 3, wherein the number of said sections is four.

5. A blank according to claim 3, wherein said inner cover portion and said connecting piece are shaped to provide a notched aperture effective to provide clearance between the edges of said tuck piece on the one hand and the flat surfaces of said inner cover portion and connecting piece on the other hand, during the operations of opening and closing said package.

6. A blank according to claim 3, wherein each of said sections is further provided with a bottom portion joined to said inner face by a score along said bottom edge of said inside face, said bottom portion being adapted to cooperate with other bottom portions to provide a closure for the bottom of a second polygonal tube made by edgewise juxtaposition of successive inner faces.

7. A blank according to claim 6, wherein at least one of said bottom portions is joined along a suitable score line to a false bottom area adapted to be folded inwardly into said second polygonal tube so as to constitute a false bottom therefor.

* * * * *